US006151922A

United States Patent [19]

Shimasaki

[11] Patent Number: 6,151,922

[45] Date of Patent: Nov. 28, 2000

[54] METHOD OF KNITTING INLAID FABRIC AND INLAID FABRIC KNITTED BY THE METHOD

[75] Inventor: Yoshinori Shimasaki, Wakayama, Japan

[73] Assignee: Shima Seiki Manufacturing Limited, Wakayama, Japan

[21] Appl. No.: 09/404,751

[22] Filed: Sep. 24, 1999

[30] Foreign Application Priority Data

Sep. 25, 1998 [JP] Japan ..... 10-271390

[51] Int. Cl.[7] ..... D04B 7/18

[52] U.S. Cl. ..... 66/61; 66/64; 66/190

[58] Field of Search ..... 66/60 R, 61–64, 66/75.1, 190–191

[56] References Cited

U.S. PATENT DOCUMENTS 782,480 2/1905 Benndorf ..... 66/61
2,069,819 2/1937 Diem ..... 66/61
5,299,435 4/1994 Whalley ..... 66/61

*Primary Examiner*—Danny Worrell
*Attorney, Agent, or Firm*—Arent Fox Kintner Plotkin & Kahn, PLLC

[57] ABSTRACT

A method of knitting an inlaid fabric including a base knitting fabric portion and an inlay yarn and an inlaid fabric knitted by the method. The method comprises the step that the base knitting fabric portion is knitted; the step that inlay yarn holding loops are formed by retaining loops of the base knitting fabric portion retained by the needles on the first needle bed to the needles on the opposed second needle bed through a split knit process, whereby the loops are retained to the needles on both of the first and second needle beds; the step that the inlay yarn is made to run across the loops retained to the needles on the first and second needle beds; the step that the inlay yarn holding loops retained by the needles on the second needle bed are transferred to the needles on the first needle bed to be overlapped with the loops of the base knitting fabric portion; and the step that a yarn is fed to the needles of the first needle bed to form loops of the next course.

2 Claims, 8 Drawing Sheets

FIG. 5

| | | | | | | | | | | |
|---|---|---|---|---|---|---|---|---|---|---|
| 1. | – | × | – | (Knitting of Back Base Knitting Fabric Portion) | – | (Transfer of Front Inlay Yarn Holding Loops ↓) | – | (Insert of Front Inlay Yarn) | → | |
| 2. | ← | (Knitting of Front Base Knitting Fabric Portion) | – | × | – | × | – | × | – | |
| 3. | – | (Split Knit-2 of Back Knitting Fabric) | – | (Knitting of Back Base Knitting Fabric Portion + Split Knit-1 of Back Knitting Fabric) | – | × | – | × | → | |
| 4. | ← | (Insert of Back Inlay Yarn) | – | (Transfer of Back Inlay Yarn Holding Loops ↑) | – | (Knitting of Front Base Knitting Fabric Portion + Split Knit-1 of Front Knitting Fabric) | – | (Split Knit-2 of Front Knitting Fabric) | – | |

METHOD OF KNITTING INLAID FABRIC AND INLAID FABRIC KNITTED BY THE METHOD

BACKGROUND OF THE INVENTION

1. Field of the Invention

The present invention relates to a method of knitting an inlaid fabric in which an inlay yarn is interlaced by use of a flat knitting machine having at least a pair of oppositely arranged, front and back needle beds and to an inlaid fabric knitted by the method.

2. Prior Art

An inlay knit structure in which an inlay yarn is integrally knitted in a base knitting fabric forms a thick-gauge knitting fabric and is superior in bulkiness and retention of shape and, therefore, is used as a knitting structure for an over-clothes and the like. An inlaid fabric using an elastic yarn, such as a rubber yarn, as the inlay yarn is a suitable material for underwears and the like requiring high stretchability. Thus, the inlay knit can be used for knitting fabrics for various uses by varying types of yarns and materials to be used in knitting and knitting conditions such as a knitting structure and others.

With reference to FIGS. 7 and 8, an example of a known method of knitting the inlaid fabric will be described below. In the course 1 in FIG. 7, a base knitting fabric portion of a plain knitting structure is knitted with needles a-s of the back needle bed. In the course 2, after the back needle bed is racked rightward by a half pitch of needle, the yarn fed to the needles of the back needle bed in the course 1 is fed to needles E, J and O of the front needle bed as well, to form loops thereat. Then, in the course 3, an inlay yarn 101 is made to run across the loops retained between the front and back needle beds through the knitting of the course 2. In the course 4, after the back needle bed is racked leftwards by a half pitch of needle, the loops retained by the needles E, J and O of the front needle bed are transferred onto the needles of the back needle bed to be overlapped with the loops on the back needle bed. In the course 5, the needles of the back needle bed are used again to form the plain knitting structure. The knitting steps shown in the above-mentioned courses 1 through 5 are repeated to knit the base portion of the plain knitting structure as shown in FIG. 8 and, as a result, the inlaid fabric in which the inlay yarn 101 is inserted every other course is knitted.

In the inlaid fabric produced by the above-mentioned knitting method, the inlay yarn is held between the back knit and the front knit of the rib knitting structure, while the loops of the rib knitting structure formed across a needle gap between the front and back needle beds are enlarged due to the knitting yarn extending between the front knit and the back knit being absorbed in the loops. Accordingly, the interval between the front knit and the back knit between which the inlay yarn is held is widened. As a result of this, when a force is exerted on the held inlay yarn in the direction of the fabric being stretched in wearing or when the inlay yarn is caught or hooked by something, there is a fear of the inlay yarn being drawn out.

In addition, since no loops of the former course exist in new loops of the rib knitting structure portion which are additionally formed at the needles of the front needle bed, gaps are produced at 103 where the new loops are formed, as shown in FIG. 8, and as such reduces the product value.

The above-mentioned problems are due to the new loops 105 in the rib knitting structure portion formed at the needles of the front needle bed being not held by the loops of the former course.

SUMMARY OF THE INVENTION

In the light of the above-mentioned problems, the present invention has been made. It is the object of the present invention to provide a method of knitting an inlaid fabric of a high product value that can prevent the held inlay yarn from being moved to be drawn out and can prevent the fabric being gaped and a novel inlaid fabric knitted by the method.

To accomplish the above-mentioned object, the present invention provides a novel method of knitting an inlaid fabric including a base knitting fabric portion and an inlay yarn by use of a flat knitting machine having at least a pair of horizontally extending first and second needle beds arranged in front and back to be opposed to each other across a needle gap and each having a number of needles, the flat knitting machine being so designed that stitches of loops can be transferred between the needle beds and also either or both of the needle beds can be racked laterally, the method comprising: the step that the base knitting fabric portion is knitted; the step that inlay yarn holding loops are formed by retaining loops of the base knitting fabric portion retained by the needles on the first needle bed to the needles on the opposed second needle bed through a split knit process, whereby the loops are retained to the needles on both of the first and second needle beds; the step that the inlay yarn is made to run across the loops retained to the needles on the first and second needle beds; the step that the inlay yarn holding loops retained by the needles on the second needle bed are transferred to the needles on the first needle bed to be overlapped with the loops of the base knitting fabric portion; and the step that a yarn is fed to the needles of the first needle bed to form loops of the next course. According to the knitting method of the present invention, the inlay yarn is made to run across the loops that are retained by the needles on the front and back needle beds via the split knit and then the new loops formed via the split knit are overlapped with the inlay yarn holding loops on the opposed needle bed to form loops of the next course at the doubled loops, so as to hold the inlay yarn therebetween. The inlay yarn holding loops are formed by splitting the loops which are each originally a single stitch of loop into two stitches of loops, ones of which are used as the inlay yarn holding loops and the others of which are used as the loops of the former course to hold the loops newly formed in the split knit process, and as such can make the inlay yarn holding loops smaller than the usual loops. Accordingly, the interval between the loops of the base knitting fabric portion and the inlay yarn holding loops can be narrowed. Therefore, the inlay yarn is securely held between the inlay yarn holing loops and the loops of the base knitting fabric portion to prevent movement of the inlay yarn.

Also, the present invention provides a novel inlaid fabric wherein an elastic yarn is used in a base knitting fabric portion and a non-elastic yarn used as an inlay yarn, and the elastic yarn is knitted in its stretched state during the knitting so that the inlay yarn can be formed into a pile-like form. According to the inlaid fabric of the present invention, when the base knitting fabric portion is shrunk at the completion of the knitting, the pile-like loops of the inlay yarn are formed on the back side of the knitting fabric.

BRIEF DESCRIPTION OF THE DRAWINGS

These and other objects and advantages of the invention will become more apparent upon a reading of the following detailed description and drawings, in which:

FIG. 5 is an illustration of another embodied form of the present invention;

DETAILED DESCRIPTION OF THE PREFERRED EMBODIMENTS

In the following, the inventive method of knitting an inlaid fabric and an inlaid fabric knitted by the method will be described in detail with reference to the accompanying drawings. In an embodied form of the present invention, the knitting of a sewing free supporter that requires no sewing process after completion of the knitting processes is taken as an example. In detail, a woolie nylon of a 110/2D (denier ply yarn) is used as an elastic yarn for a knitting yarn for the base knitting fabric portion and a chenille yarn 7/1 (a single yarn of a yarn count number 7) is used as a non-elastic yarn for a knitting yarn for the inlay yarn, and a front knitting fabric and a back knitting fabric are connected together at both ends thereof to form a tubular body so as to knit the sewing free supporter.

Figure 1:
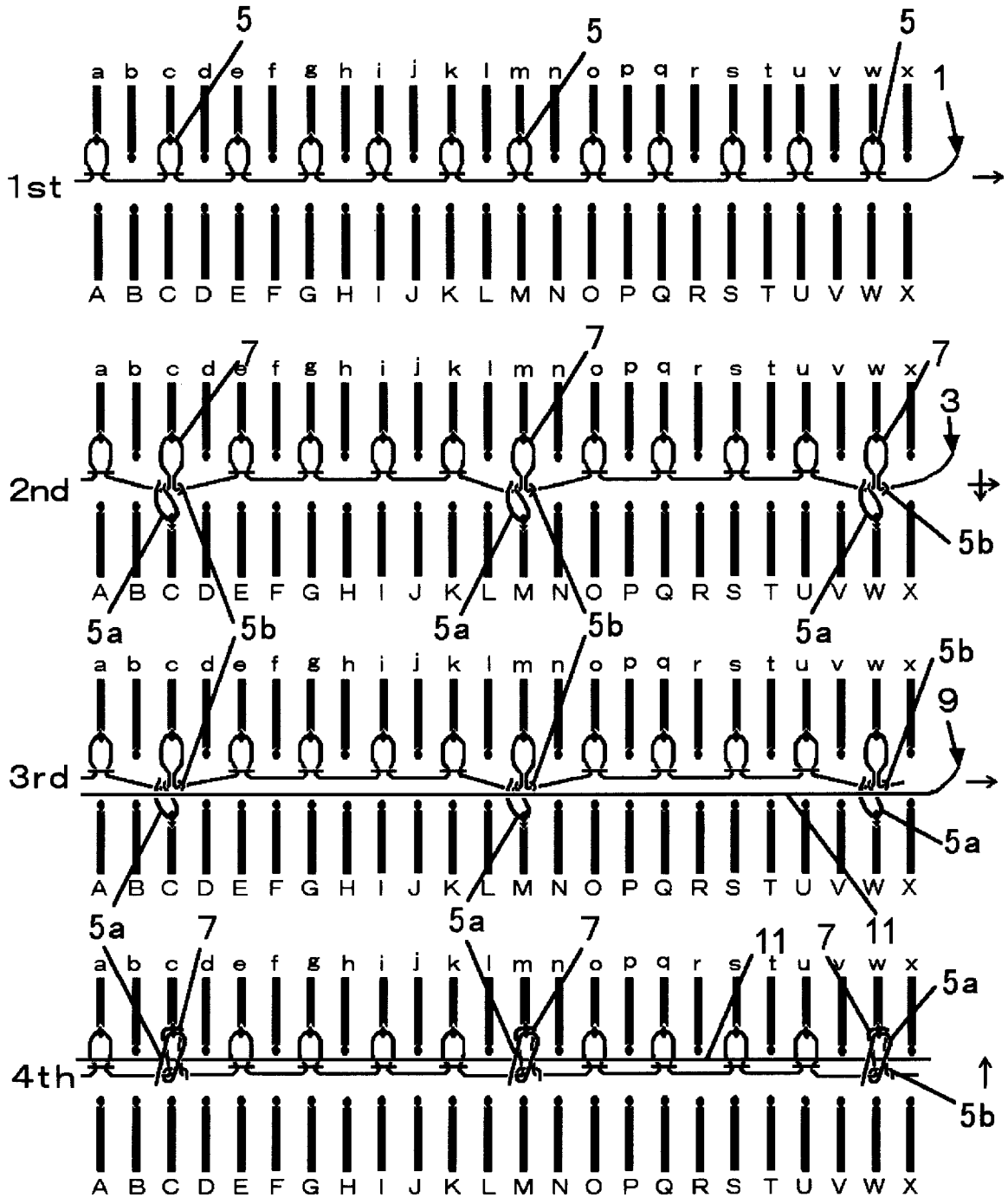
FIG. 1 is an illustration of a knitting course, showing the knitting of a back knitting fabric portion of a supporter as is knitted as an embodied form of the present invention.
Figure 2:
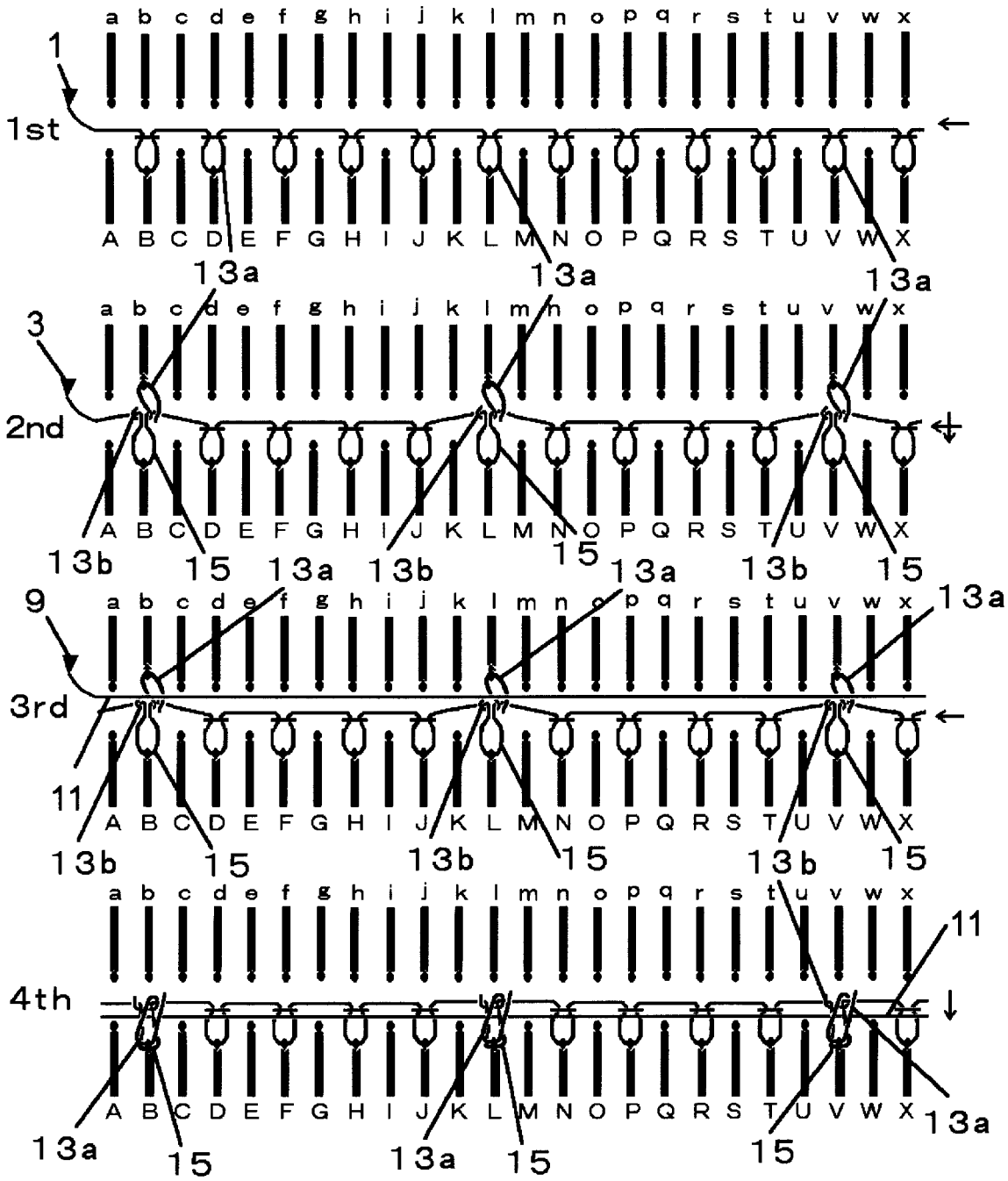
FIG. 2 is an illustration of a knitting course, showing the knitting of a front knitting fabric portion of the supporter as is knitted as the embodied form of the present invention.

FIGS. 1 and 2 are diagrams of the knitting courses showing an example of the knitting method of the inlaid fabric. In the illustrated embodiment, a two-bed flat knitting machine is used which includes a pair of front and back needle beds each having a number of latch needles having transferring clips at one side surface thereof for allowing the hooks to be opened or closed by their latches and in which the back needle bed is so designed as to be movable laterally. In the illustrated embodiment, to ensure the transferring of stitches between the front and back needle beds in the process of knitting the tubular fabric by use of the two-bed flat knitting machine, the knitting method disclosed by JP Patent Publication No. Hei 3(1991)-75656 is adopted. According to the prior art, the two-bed flat knitting machine having front and back needle beds oppositely arranged in front and back is used to knit the fabric into a tubular form by use of alternate needles of each of the front and back needle beds, assigning the stitches of the front knitting fabric to odd needles and assigning the stitches of the back knitting fabric to even needles, for example. When the front knitting fabric is knitted, the back knitting fabric is allowed to belong to the needles of the back needle bed. On the other hand, when the back knitting fabric is knitted, the front knitting fabric is allowed to belong to the needles of the front needle bed. The knitting fabrics are knitted in the state of being overlapped in front and back. This enables the respective knitting fabrics to surely be allocated to the transferring empty needles on the opposed needle beds. As a result of this, a mixed structure pattern of the front knits/back knits of links, purl stitch, rib stitch and the like can be knitted into a tubular form. In the case of a four-bed flat knitting machine further including another pair of needle beds arranged in front and back being used, the front knitting fabric is knitted with the needles on a front lower bed and a back upper bed and similarly, the back knitting fabric is knitted with the needles on a back lower bed and a front upper bed. Thus, the need for assigning the front knitting fabric to the odd needles and assigning the back knitting fabric to the even needles in the two-bed flat knitting machine is eliminated. It is to be noted in the following description that the flat knitting machine used has four sets of cam systems on each of the front and back carriages. Of the four sets of cams provided on the same carriage, the cam system located foremost with respect to the traveling direction of the carriage is called as the 1st cam and the following cams are called as the 2nd cam, the 3rd cam and the 4th cam in the positional order. In FIGS. 1 and 2 showing the diagrams of knitting courses, the numbers of cams are shown at the left side, and the knitting of the 1st cam is shown at the top and the knitting effected by the 2nd cam, 3rd cam and 4th cam are shown in descending order. The horizontal arrows at the right side of the diagram of the knitting courses indicate a yarn feeding direction and the vertical arrows indicate a stitch transferring direction. The capital letters of alphabets labeled at the top and bottom of the each knitting course indicate the needles of the front bed and the small letters of alphabets thereat indicate the needles of the back bed.

First of all, in the course 1 of FIG. 1, the carriage is moved rightward to feed the woolie nylon for knitting a base knitting fabric portion to alternate needles a, c, e, . . . , s, u, and w of the back needle bed through a yarn feeder 1 via the 1st cam located at the foremost with respect to the traveling direction of the carriage, so as to knit the base knitting fabric portion of the back knitting fabric. When the yarn of woolie nylon is fed through a yarn feeder 3 to the alternate needles a, c, e, . . . , s, u, and w of the back needle bed, at which loops were formed via the 1st cam, to form loops of the next course, the split knit is performed with the needles c, m and w of the back needle bed via the 2nd cam, to transfer the old loops 5 as retained by the needles c, m and w of the back needle bed to the needles C, M and W of the front needle bed to form inlay yarn holding loops as will be described later. This results in the state of the loops being retained by the needles of both of the front and back needle beds, as shown in FIG. 1. It should be noted that what is meant by the "split knits" is that when the needles holding the old loops 5 are moved forward to hook an additionally fed knitting yarn and draw it in so as to form loops 7 of the next course, the old loops 5 are passed to the opposed needles so that the loops are retained to the opposed front and back needles. As the split knit by the latch needles is described in detail by JP Patent Publication No. Sho 62(1987)-52063, any further detailed description thereon is omitted hereat. The old loops 5 transferred to the needles c, m and w of the back needle bed, which are originally a single stitch of loop, are each split into two stitches of loops 5*a* and 5*b*. Ones 5*a* of the split loops are retained by the needles C, M and W of the front needle bed, and the others 5*b* of the split loops result in the loops 5*b* of the former course at the additionally formed loops 7. After the loops are brought to be retained to the needles of both of the front and back needle beds through the knitting effected by the 2nd cam, the chenille yarn used as the inlay yarn 11 is made to run across the loops retained by the needles of both of the front and back needle beds through a yarn feeder 9 via the 3rd cam. The inlay yarn holding loops 5*a* retained by the needles C, M and W of the front needle bed are transferred to the opposed needles c, m and w of the back needle bed to be doubled via the 4th cam. As a result of this, the inlay yarn 11 is put into the state of being retained in sandwich relation between the new loops 7 of the base knitting fabric portion and the inlay yarn holding loops 5*a* by the needles c, m and w of the front needle bed.

Then, the knitting is shifted to the knitting of the front knitting fabric shown in FIG. 2. The yarn of woolie nylon is fed to alternate needles X, V, T, . . . , F, D, and B of the back needle bed through a yarn feeder 1 via the 1st cam to form a base portion of the front knitting fabric. Then, the woolie nylon is fed to the needles D, F, H, J, N, P, R, T and X of the front needle bed through the yarn feeder 3 and also the split knit is performed with the needles B, L and V via the 2nd cam, so that loops 15 are formed at the needles B, L and V of the front needle bed and also the inlay yarn holding loops 13*a* are retained to the needles b, l and v of the back needle bed. The chenille yarn used as the inlay yarn 11 is made to run across the loops retained by the needles of the front and back needle beds through the yarn feeder 9 via the 3rd cam. The loops 13*a* retained by the needles b, 1 and v of the back needle bed are transferred to the needles B, M and L of the front needle bed to be overlapped with the loops 15 of the base knitting fabric portion via the 4th cam. As a result of this, the inlay yarn 11 is put into the state of being retained in sandwich relation between the loops 15 of the base knitting fabric portion and the inlay yarn holding loops 13*a* by the needles B, M and L of the front needle bed.

Figure 3:
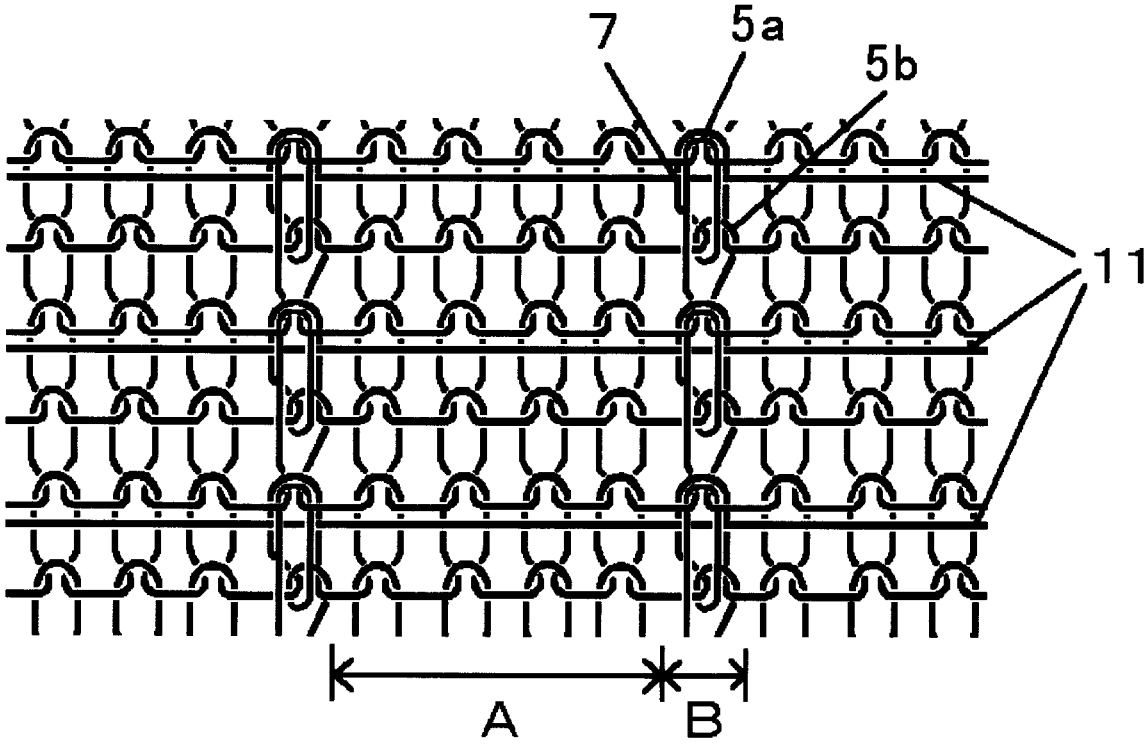
FIG. 3 is an illustration of loops of the back knitting fabric portion of the supporter knitted in accordance with the diagrams of the knitting courses of FIGS. 1 and 2, as viewed from the inside of the knitting fabric.
Figure 4:
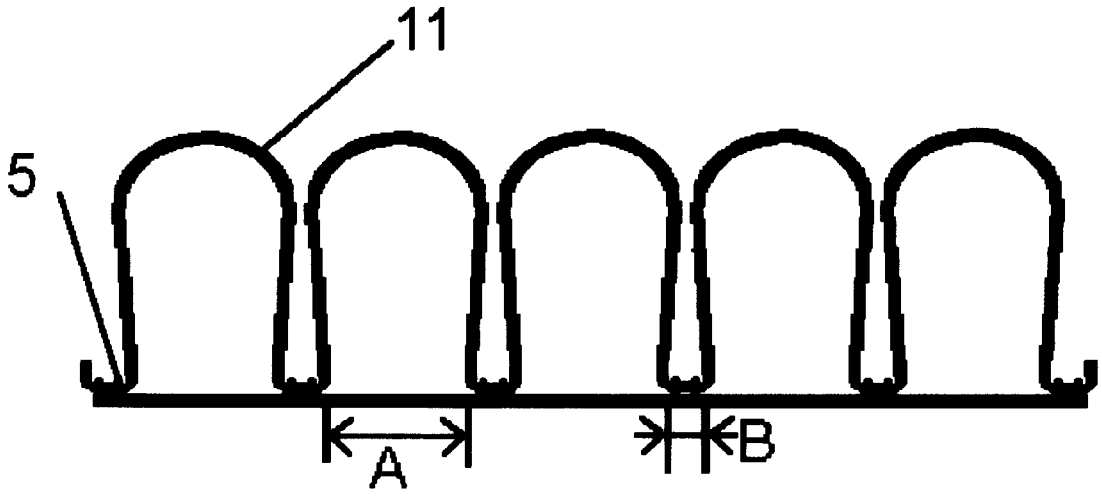
FIG. 4 is a sectional view of the knitting fabric as is knitted with an elastic yarn used in a base portion and a non-elastic yarn used as the inlay yarn.

Thereafter, the knitting of FIGS. 1 and 2 are repeated, whereby the loops of the next course are formed at the loops which are in the state of the new loops 7, 15 of the base knitting fabric portion and the inlay holding loops 5*a*, 13*a* being overlapped with each other, and the inlay yarn 11 is integrally held in the base knitting fabric portion. The fabric knitted by the above-mentioned knitting steps becomes a knitted fabric in which the inlay yarn 11 is inserted in every two courses, as shown in FIG. 3 (FIG. 3 shows the state of the back knitting fabric as viewed from the inside of the fabric). When the fabric is taken out of the knitting machine, the base knitting fabric portion formed of the woolie nylon is shrunk, as shown in FIG. 4. As a result of this, the inlay yarn integrally held in the base knitting fabric portion at B is curved at A, resulting in the knitted fabric forming therein pile-like loops made by the chenille yarn.

While the knitting effected by the flat knitting machine using the latch needles for allowing the hooks to be opened or closed by their latches is discussed in the above illustration, the knitting effected by another flat knitting machine will be described below. In this flat knitting machine, compound needles are arranged in parallel on each of the needle beds whose heads are opposed to each other across the needle gap. Hooks of their needle bodies are slidably held in sandwich relation via two elastic plates having tongues at tip ends thereof, as disclosed by JP Patent Application No. Hei 9(1997)-245741 (correspond to JP Patent Application Laid-Open No. Hei 11(1999)-152664 and European Patent Application Laid-Open No.0875614A), so that the hooks can be opened or closed by the tongues and also the transferring of stitches can be effected by use of the tongues. When the knitting is performed by the compound needles, the needles holding the old loops are raised forward to their knitting positions so that an additionally fed yarn can be received in their hooks to be drawn into the old loops and then are retracted downward. In this process, in order to prevent the old loops from passing over the tip ends of sliders to be knocked over, the tip ends of the sliders are shifted beyond the hooks to maintain the needles in their raised-forward positions above the needle gap. After the new loops are drawn into the old loops, with the old loops held by the tongues of the sliders, the hooks of the compound needles on the opposed needle beds are moved forward into between the tongues retaining the loops so as to be inserted in the old loops. Subsequently, the sliders are retracted downward and also the old loops are received in the hooks of the needles on the opposed needle beds, and thereby the new loops and the old loops are retained to the needles on the opposed needle beds, respectively, to do the split knit. In the above-mentioned knitting, the first half of the split knit done before the step of the new loops being drawn into the old loops to form additional loops is conducted via a leading cam system, and the second half of the split knit done before the step of the old loops being transferred to the needles on the opposed needle beds is conducted via a trailing can system. In this flat knitting machine, the carriage is provided with at least two cam systems having slider controlling cam locks and arranged in parallel at the needle gap side of a needle raising/lowering cam lock comprising a raising cam and knitting cams provided at opposite sides thereof In the leading cam system, a slider butt passage along which the tongues of the sliders are kept in the hook passing position and also are advanced to the loop split position (stitch transferring position) is provided between the adjoining knitting locks so that even when the hooks of the needle bodies advanced to the needle gap for the knitting are operated to draw the knitting yarn therein and then are retracted, the old loops on the sliders can be prevented from being knocked over.

Figure 6:
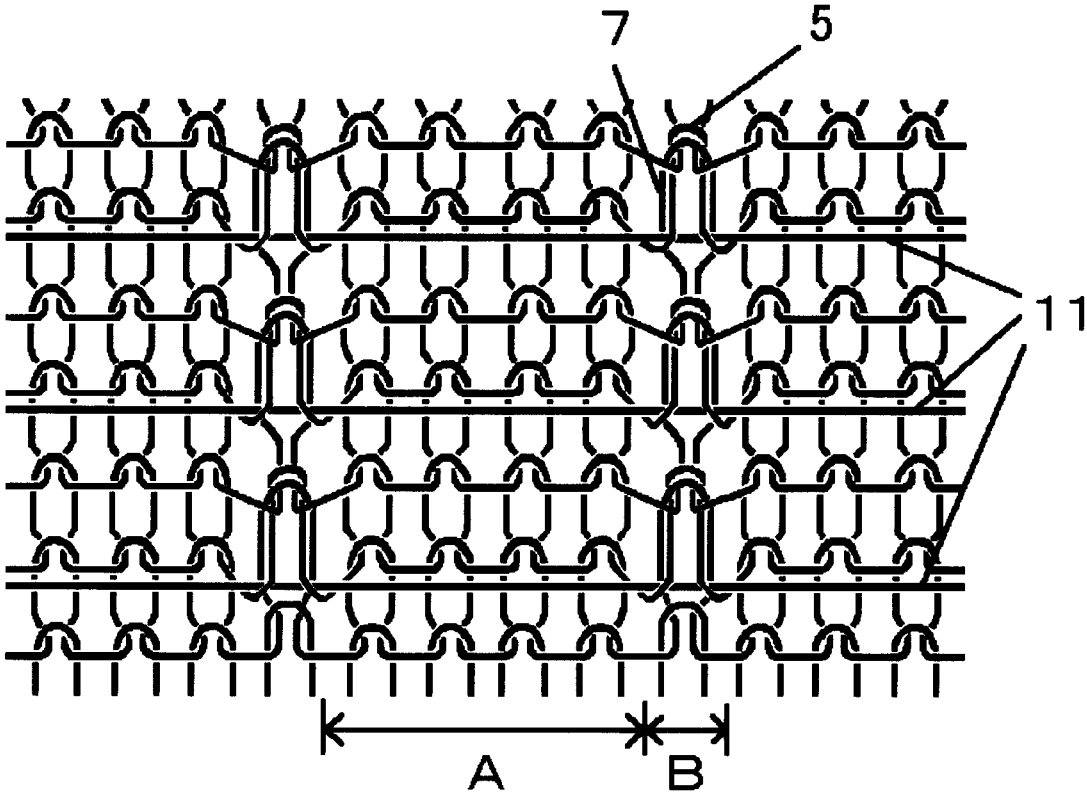
FIG. 6 is an illustration of loops of the inlaid fabric knitted in accordance with the knitting shown in FIG. 5.
Figure 7:
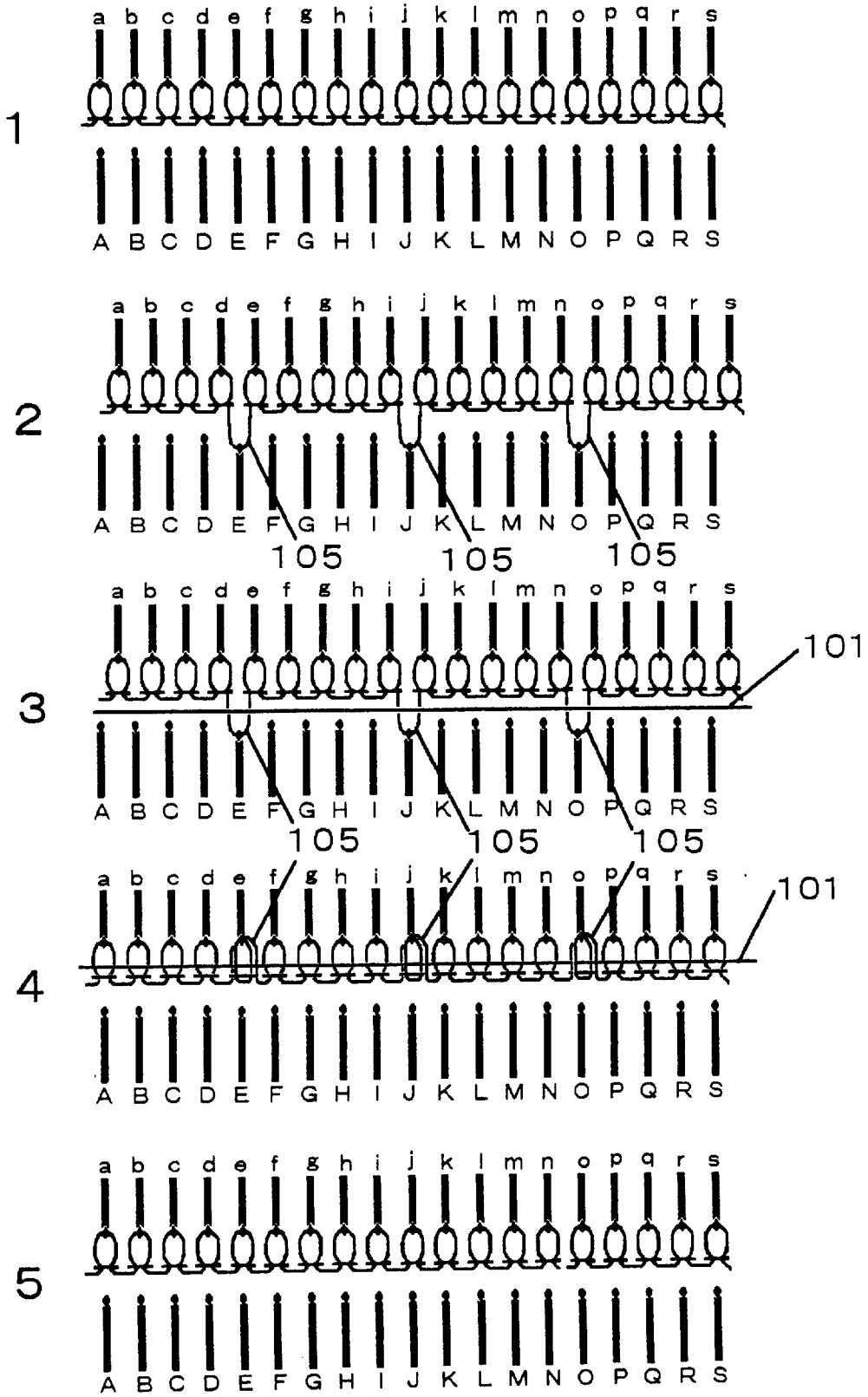
FIG. 7 PRIOR ART
FIG. 7 is an illustration of a knitting course, showing a known method of knitting the inlaid fabric.
Figure 8:
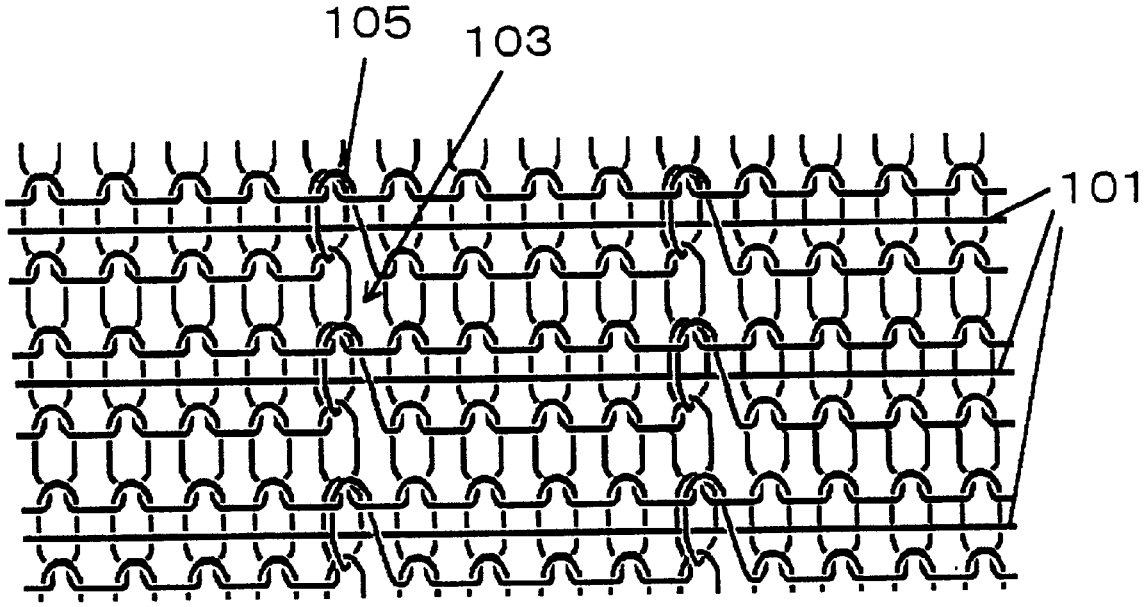
FIG. 8 PRIOR ART
FIG. 8 is an illustration of loops of the inlaid fabric knitted in accordance with the diagram of the knitting course of FIG. 7.

Now, with reference to FIG. 5, description on the diagram of the knitting for the use of the compound needles and the compound needle controlling cam locks will be given below. In the course 1 of FIG. 5, the inlay yarn for the front knitting fabric is made to run across the loops as retained by the needles on both of the front and back needle beds due to the knitting of the former courses (not shown), via the 1st cam located foremost with respect to the traveling direction of the carriage as indicated by the horizontal arrow. The inlay yarn holding loops of the front knitting fabric as were retained by the needles on the back needle bed are transferred to the needles on the front needle bed via the 2nd cam, and the base knitting fabric portion of the back knitting fabric is knitted via the 3rd cam. Subsequently, in the course 2, the carriage is moved leftward to knit the base portion of the front knitting fabric via the 1st cam. In the course 3, the carriage is moved rightward to do the knitting of the base knitting fabric portion of the back knitting fabric and the first half of the split knit of the loops of the back knitting fabric (the split knit−1) via the 3rd cam. The needles receiving therein the loops formed in the knitting via the 3rd cam are retracted downward to do the second half of the split knit (the split knit−2) via the 4th cam. In the course 4, the carriage is moved leftward so that the inlay yarn for the back knitting fabric is made to run via the 1st cam. The inlay yarn holding loops of the back knitting fabric are transferred to the needles on the back needle bed via the 2nd cam. The knitting of the base knitting fabric portion of the front knitting fabric and the first half of the split knit of the front knitting fabric (the split knit−1) are done via the 3rd cam, and the second half of the split knit (the split knit−2) is done via the 4th cam. Shown in FIG. 6 is a diagram of the loops of the fabric as knitted by repetition of the knitting of the above-mentioned courses 1 to 4. 21 designates the inlay yarn. 23 designates the loops of the base knitting fabric portion. 25 designates the inlay yarn holding loops. The difference between the diagram of the loops of FIG. 6 and that of FIG. 3 results from the following. The first embodiment uses the latch needles which are so designed that the hooks of the needles are advanced into the transferring clips having receiving needles at the sides of the needles to do the transferring of stitches. In contrast to this, the second embodiment uses the compound needles which are so designed that the hooks of the needles are advanced in the space defined between the two elastic plates to do the transferring of stitches.

As aforementioned, according to the method of knitting the inlay fabric of the embodiments of the present invention, the split knit is done and thereby the loops 5, 13, which are originally a single stitch of loop, are each split into two stitches of loops 5*a*, 5*b*, 13*a*, 13*b*. Ones 5*b*, 13*b* of the split loops are used as the loops of the former course to hold the loops 7, 15 newly formed at the empty needles, and the others 5*b*, 13*a* of the split loops are retained to the needles on the opposed needle bed as the inlay yarn holding loops. After the loops are retained between the needles of both of the front and back needle beds and the inlay yarn is made to run across the loops, the inlay yarn holding loops are overlapped with the loops of the base knitting fabric portion to hold the inlay yarn therebetween. Thus, according to the method of knitting the inlay fabric of the present invention, since the inlay yarn holding loops are formed by splitting the loops which are each originally a single stitch into two stitches of loops, the loops smaller than the usual loops are formed. Therefore, the interval between the inlay yarn holding loops and the loops of the base knitting fabric portion is narrowed, so that the inlay yarn is securely held between the inlay yarn holing loops and the loops of the base knitting fabric portion to prevent movement of the inlay yarn.

While the base knitting fabric portion is knitted with the plain knit structure in the above-illustrated embodiments, the knit structure of the base knitting fabric may be of other knit structure, such as a rib knit structure and a wide rib knit structure, than the plain knit structure. Also, while the inlay yarn is inserted every two courses and the single stitch of the inlay yarn holding loop is formed every five stitches of loops of the base fabric portion in the above-illustrated embodiments, the interval at which the inlay yarn is inserted and the proportion in which the inlay yarn holding loops are formed may be freely set.

Further, while the knitting of the sewing free supporter knitted into a tubular form is taken in the above-illustrated embodiments, the knitting method of the present invention is not limited to the knitting of the tubular knitting fabric. Also, while the woolie nylon of the elastic yarn is used in the base knitting fabric portion and the chenille yarn of the non-elastic yarn is used as the inlay yarn to knit the pile-fabric-like knitting fabric, the types of the knitting yarn used for the knitting are cited merely by way of example and without limitation.

According to the method of knitting the inlay fabric of the present invention, the inlay yarn is made to run across the loops that are retained between the needles on the front and back needle beds via the split knit process and then the loops newly formed via the split knit are overlapped with the loops as were transferred to the needles on the opposed needle bed to form the loops of the next course at the doubled loops, so as to hold the inlay yarn therebetween. The inlay yarn holding loops are formed by splitting the loops which are each originally a single stitch into two stitches of loops, ones of which are used as the inlay yarn holding loops and the others of which are used as the loops of the former course to hold the loops newly formed through the split knit process, and as such can make the inlay yarn holding loops smaller than the usual loops. Accordingly, the interval between the loops of the base knitting fabric portion and the inlay yarn holding loops can be narrowed. Therefore, the inlay yarn is securely held between the inlay yarn holing loops and the loops of the base knitting fabric portion to prevent movement of the inlay yarn.

It is desirable that the elastic yarn is used in the base knitting fabric portion and the non-elastic yarn is used as the inlay yarn, and the elastic yarn is knitted in its stretched state during the knitting so that when the base knitting fabric portion is shrunk at the completion of the knitting, the pile-like loops of the inlay yarn can be formed on the back side of the knitting fabric. This can produce the advantageous effect that a knitted fabric having a pile-fabric-like texture can be obtained even by the flat knitting machine having no particular pile knitting mechanism.

While the preferred embodiments of the invention have been described, it is to be understood that various changes and modifications may be made in the invention without departing from the sprit of the present invention. The scope of the invention, therefore, is to be determined solely by the following claims.

What is claimed is:

1. A method of knitting an inlaid fabric including a base knitting fabric portion and an inlay yarn by use of a flat knitting machine having at least a pair of horizontally extending first and second needle beds arranged in front and back to be opposed to each other across a needle gap a nd each having a number of needles, said flat knitting machine being so designed that stitches of loops can be transferred between said needle beds and also either or both of said needle beds can be racked laterally, said method comprising:

the step that said base knitting fabric portion is knitted;

the step that inlay yarn holding loops are formed by retaining loops of said base knitting fabric portion retained by said needles on said first needle bed to said needles on the opposed second needle bed through a split knit process, whereby said loops are retained to said needles on both of the first and second needle beds;

the step that said inlay yarn is made to r un across sa id loops retained to said needles on the first and second needle beds;

the step that said inlay yarn holding loops retained by said needles on said second needle bed are transferred to said needles on the first needle bed to be overlapped with said loops of said base knitting fabric portion; and the step that a yarn is fed to said needles of the first needle bed to form loops of the next course.

2. An inlaid fabric knitted by the knitting method of claim 1, wherein an elastic yarn is used in a base knitting fabric portion and a non-elastic yarn is used a s an inlay yarn and wherein said elastic yarn is knitted in its stretched state during the knitting so that said inlay yarn can be formed into a pile-like form.

* * * * *